United States Patent [19]

Shibatani et al.

[11] Patent Number: 4,596,652

[45] Date of Patent: Jun. 24, 1986

[54] PROCESS FOR PRODUCING MESOPHASE PITCH

[75] Inventors: Haruo Shibatani; Kunimasa Takahashi, both of Ibaraki, Japan

[73] Assignee: Mitsubishi Petrochemical Co., Ltd., Tokyo, Japan

[21] Appl. No.: 578,102

[22] Filed: Feb. 8, 1984

[30] Foreign Application Priority Data

Feb. 23, 1983 [JP] Japan ..... 58-28986

[51] Int. Cl.[4] ..... C10C 1/00; C10C 3/00

[52] U.S. Cl. ..... 208/44; 208/39; 208/22; 423/447.2; 423/447.6

[58] Field of Search ..... 208/22, 39, 44; 423/447.2, 447.4

[56] References Cited

U.S. PATENT DOCUMENTS

| | | | |
|---|---|---|---|
| 3,970,542 | 7/1976 | Bongertman | 208/22 |
| 4,414,096 | 11/1983 | Dickakian | 208/39 |
| 4,460,557 | 7/1984 | Takashima et al. | 208/39 |

FOREIGN PATENT DOCUMENTS

| | | | |
|---|---|---|---|
| 198788 | 12/1982 | Japan | 208/44 |
| 8008786 | 1/1983 | Japan | 208/22 |
| 679615 | 8/1979 | U.S.S.R. | 208/44 |

*Primary Examiner*—Andrew H. Metz
*Assistant Examiner*—Helane Myers
*Attorney, Agent, or Firm*—Oblon, Fisher, Spivak, McClelland & Maier

[57] ABSTRACT

A process for producing a mesophase pitch by heating a carbonaceous pitch at 350° to 550° C. wherein the heat treatment is conducted while supplying a hydrogen donor to the pitch. The mesophase pitch thus produced has an excellent spinnability.

16 Claims, No Drawings

PROCESS FOR PRODUCING MESOPHASE PITCH

FIELD OF THE INVENTION

The present invention relates to a process for producing a mesophase pitch. According to the process of this invention, a mesophase pitch having an excellent spinnability can be easily produced.

BACKGROUND OF THE INVENTION

Almost all of the commercially available carbon fibers are produced from a polyacrylonitrile fiber. Those carbon fibers are very expensive because the polyacrylonitrile fiber as the raw material is expensive and the yield of the carbon fiber is low. In contrast to the conventional process, a specific attention is recently drawn to a process for producing the carbon fiber from a carbonaceous pitch as a process for producing an inexpensive carbon fiber because the raw material is inexpensive and the yield of carbon fiber is high.

One of the important features required in the mesophase pitch used as the raw material for carbon fiber is that the mesophase pitch has an excellent spinnability. To achieve this requirement, it is desired for the mesophase pitch to be the content of quinoline-insoluble high molecular weight components small. Thus, a process for producing a mesophase pitch containing quinoline-soluble low molecular weight mesophase is demanded.

Unexamined Published Japanese Patent Application No. 160427/1979 discloses a process for producing a quinoline-soluble mesophase by extracting an isotropic pitch with a solvent and heating the insolubles at 230° to 400° C.

Unexamined published Japanese Patent Application No. 55625/1979 discloses a process for producing a mesophase pitch containing a pyridine-soluble mesophase by heat treating with stirring an isotropic pitch at 380° to 430° C. in an inert gas stream.

Unexamined published Japanese Patent Application No. 57881/1981 discloses a process for producing a mesophase pitch containing a pyridine-soluble mesophase by subjecting a pitch to physical operations such as a solvent extraction.

Unexamined published Japanese Patent Application No. 101915/1981 discloses a process for producing a mesophase pitch containing a pyridine-soluble mesophase by heat treating a pitch precursor such as ethylene tar at 400° to 550° C. under pressure and then heat treating the same in an inert gas atmosphere under the atmospheric pressure.

Unexamined published Japanese Patent Application No. 42924/1982 discloses a process for producing a mesophase pitch by heat treating with stirring a pitch precursor under the atmospheric pressure and then heat treating the same with stirring in an inert gas stream.

Unexamined published Japanese Patent Application No. 119984/1982 discloses a process for producing a mesophase pitch by heat treating a catalytic cracking by-produced tar at 380° C. or more to produce a mesophase in an amount of 20 to 80%, allowing to stand the resulting product at 400° C. or less to precipitate the mesophase at the lower layer and separating the same.

Unexamined published Japanese Patent Application Nos. 168987/1982 and 168988/1982 disclose a process for producing a mesophase pitch by adding a partially hydrogenated product of two-ring or three-ring aromatic hydrocarbons to a heavy oil formed by steam cracking and catalytic cracking of petroleums, heat treating at 370° to 480° C. and then heat treating at 340° to 450° C. under normal pressure or reduced pressure in an inert gas stream.

Unexamined published Japanese Patent Application Nos. 168989/1982 and 168990/1982 disclose a process for producing a mesophase pitch by treating the same raw material as described above at 400° to 500° C. under pressurized hydrogen and then heat treating in the same manner as described above.

Unexamined published Japanese Pat. Nos. 170990/1982, 179285/1982, 179286/1982, 179287/1982, and 179288/1982 disclose a process for producing a mesophase pitch by adding to the same raw material as described above hydrogenated products of the fractions having a boiling point of 160° to 400° C. which are formed in various steps in the course of the production thereof, treating at 370° to 480° C., and performing the same heat treatment as above.

Other than these processes for producing a mesophase pitch, the following methods for the improvement of spinnability of mesophase pitch are proposed.

According to Unexamined Published Japanese Patent Application No. 100186/1982, a latent anisotropic pitch is obtained by hydrogenating a mesophase pitch with an alkali metal.

According to Unexamined Published Japanese Patent Application No. 18421/1983, a premesophase is obtained by reacting a pitch with tetrahydroquinoline at 300° to 500° C. and then heat treating at 450° C. or more under reduced pressure for a short period of time.

The mesophase pitches thus obtained are all optically isotropic but become anisotropic in the spinning step and the subsequent steps to give a high-performance carbon fiber.

Thus, the conventional processes involve the disadvantages that the steps are complicated, the treatment time is long and an expensive reagent is used.

SUMMARY OF THE INVENTION

As the result of extensive investigations on the process for producing a mesophase pitch as a raw material for a carbon fiber having an excellent spinnability and also excellent performances and which is advantageous as compared with the conventional process, it has been found that the object can be easily attained by a simple method of heat treating while supplying a hydrogen donor.

Accordingly, an object of this invention is to provide a process for producing a mesophase pitch by heat treating a carbonaceous pitch at 350° to 550° C., wherein the heat treatment is conducted while supplying a hydrogen donor to the pitch.

DETAILED DESCRIPTION OF THE INVENTION

The raw material pitch used in this invention is a pitch obtained from coal tar, residual oil (catalytic cracking bottom) which is formed by the catalytic cracking of petroleum fractions, or residual oil (ethylene bottom) which is formed in the production of ethylene by thermal cracking of petroleum fractions. Products obtained by modifying the tar and residual oils or the fractions thereof, e.g., heat treatment, reaction with a hydrogen donor, or reaction with hydrogen in the presence or absence of catalyst, can also be used. In the case of using the ethylene bottom as the raw material, it is preferred that such is previously treated at 400° to 520° C. under a hydrogen pressure of 5 to 250 kg/cm$^2$ in the absence of a catalyst or in the presence of an appropriate catalyst or carrier. Further, the raw material pitch can be used in the form of tar containing light fractions.

The preferred hydrogen donor used in this invention is a partially-hydrogenated condensed polycyclic aromatic compound and/or nitrogen-containing heterocyclic compound. Examples of such compounds include tetralin, 9,10-dihydroanthracene, 9,10-dihydrophenanthrene, hydropyrene, and 1,2,3,4-tetrahydroquinoline. Those are used alone or in mixtures thereof.

The hydrogen donor is supplied in an amount of 1 mmol to 10 mol/minute, preferably 10 mmol to 1 mol/minute, per 1 kg of pitch. The hydrogen donor is added in the form of previously vaporized gas but may also be added in the form of liquid. The hydrogen donor added in the form of liquid immediately vaporizes on contact with the pitch.

The hydrogen donor is preferably supplied continuously, though it may be supplied intermittently.

The heat treatment is conducted while blowing an inert gas so as to remove light components from the raw material.

Examples of the inert gas include nitrogen, argon, gaseous hydrocarbons such as methane and ethane, and hydrocarbons which gasify under the heat treatment conditions. The inert gas is blown in an amount of 200 to 5000 liters/hour, preferably 400 to 3000 liters/hour, per 1 kg of the raw material pitch.

The heat treatment is conducted at 350° to 550° C., preferably 380° to 520° C., and most preferably 400° to 500° C. Heat treatment at a temperature lower than 350° C. takes a long time; and at a temperature higher than 550° C., the reaction rate is too fast to control adequately.

The time required for heat treatment is 10 seconds to 50 hours, preferably 1 minute to 20 hours, though varying depending on the type of raw material pitch, the heat treatment temperature, and the type and feed rate of the hydrogen donor.

The hydrogen donor supplied is discharged from the reaction system together with the inert gas and/or the light components distilled and formed from the raw material. The discharged hydrogen donor is recovered if desired and necessary and the recovered hydrogen donor is reused directly or after hydrogenation.

The pitch obtained according to the process of this invention can be made into a high performance carbon fiber by melt-spinning, infusibilizing, carbonization, and graphitization in the conventional manners.

The most remarkable effect of the process of this invention is in improving the spinnability. The pitch produced according to the process of this invention contains smaller quinoline-insolubles than that produced by blowing an inert gas alone and can be spun at a lower temperature with less frequencies of filament breakage. The mesophase pitch obtained according to the process of this invention contains 40 to 100 wt % of the mesophase when observed with a polarizing microscope at room temperature. Further, the mesophase pitch contains 50 wt % or less of quinoline-insolubles.

The reaction mechanism that takes place in the process of this invention is not clear but it is believed to be an important reaction that the hydrogen donor acts on the free radical having the polycyclic aromatic structure, which is formed in the course of heat treatment, to stabilize and prevent polymerization. It is therefore believed that this is the reason why the process of this invention is advantageous and requires a less amount of hydrogen donor as compared with the process in which pitch is previously hydrogenated by the reaction with a hydrogen donor and then heat treating the same in the conventional manner.

The invention is now described in more detail by reference to the following examples.

EXAMPLE 1

Into a 1 l autoclave were charged 630 g of ethylene bottom (having a boiling point of 170° C. or higher as converted to that under normal pressure) formed by thermal cracking of naphtha and 30 g of silica-alumina catalyst for fluidized catalytic cracking. The autoclave was heated from room temperature to 460° C. over 140 minutes, while introducing hydrogen at a rate of 100 liters/hour (STP) and keeping the reaction pressure at 120 kg/cm$^2$. The autoclave was kept at the same temperature for 80 minutes. After cooling to room temperature, the solid content was taken out and filtered. The fractions having a boiling point of 490° C. or lower (as converted into that under normal pressure) were removed from the solid by distillation. Thus, there was obtained a modified ethylene bottom pitch in a yield of 25 wt %.

10 g of the modified pitch obtained above was placed in a 40 ml reactor provided with an internal cylinder to prevent the backflow of distillate to the pitch. The reactor was kept at room temperature for 10 minutes while introducing argon at a rate of 350 l/min and liquid 1,2,3, 4-tetrahydroquinoline at a rate of 0.13 g per minute and then dipped in a molten salt bath at 485° C. After the pitch had melted, the argon and tetrahydroquinoline were introduced into the molten pitch. The heat treatment was conducted at 483° C. for 12 minutes. Thus, there was obtained the heat-treated pitch in a yield of 52 wt % based on the modified pitch.

A sample was prepared by embedding the heat-treated pitch in epoxy resin and polishing the embedded pitch. The content of mesophase in the heat-treated pitch was measured by observing the sample with a polarizing microscope at room temperature. The content of mesophase was approximately 100%. The content of quinoline-insolubles was 34% (as measured according to the centrifugal method provided in JIS 2425).

3 g of the pitch was charged in a vessel provided with a spinneret having a hole diameter of 0.5 mm. The pitch was melt spun at a rate of 420 m/min at 392° C. under a pressure of 100 cmAq with argon. Melt-spinning could be conducted at 392° C. for 24 minutes without breakage.

COMPARATIVE EXAMPLE 1

Modified pitch and heat-treated pitch were obtained in the same manner as in Example 1 except that the heat treatment was carried out without tetrahydroquinoline. The yield of the heat-treated pitch obtained was 55 wt %, the mesophase content was about 100% and the quinoline insoluble content was 43%. Further, the spinning temperature was 406° C. and the continuous spinning time was 11 minutes.

COMPARATIVE EXAMPLE 2

Heat-treated pitch was obtained in the same manner as in Example 1 except that the supply of tetrahydroquinoline was suspended immediately before the heat treatment reactor tube was dipped in the molten salt bath. The yield of the heat-treated pitch was 56 wt %, the mesophase content was about 95% and the quinoline insoluble content was 40%. Further, the melt spinning could be continued for 11 minutes at the spinning temperature of 400° C.

EXAMPLE 2

Example 1 was repeated except that the heat treatment time was changed to 10 minutes. The yield of the heat-treated pitch was 53 wt %, the mesophase content was about 70% of mesophase and the quinoline insoluble content was 20%. The melt spinning could be continued for 35 minutes at the spinning temperature of 370° C.

COMPARATIVE EXAMPLE 3

Example 2 was repeated except that the heat treatment was carried out without tetrahydroquinoline. The yield of the heat-treated pitch was 58 wt %, the mesophase content was 85% and the quinoline insoluble content was 22%. The melt spinning could be continued for 14 minutes at the spinning temperature of 381° C.

EXAMPLE 3

Example 1 was repeated except that the heat treatment was carried out at 455° C. for 40 minutes. The yield of heat-treated pitch was 55 wt %, the mesophase content was about 80% and the quinoline insoluble content was 9%.

EXAMPLE 4

Example 1 was repeated except that the heat treatment was carried out at 430° C. for 150 minutes. The yield of the heat-treated pitch was 48 wt %, the mesophase content was about 100% and the quinoline insoluble content was 19%.

EXAMPLE 5

Example 1 was repeated except that the heat treatment was carried out at 400° C. for 8 hours. The yield of the heat-treated pitch was 51 wt %, the mesophase content was about 80% and the quinoline insoluble content was 2%. The melt spinning could be continued for 38 minutes at the spinning temperature of 334° C.

EXAMPLE 6

Example 1 was repeated except that tetralin was used as the hydrogen donor and was added at a rate of 0.20 g/min. The yield of the heat-treated pitch was 53 wt %, the mesophase content was about 70% and the quinoline insoluble content of 23%. The melt spinning could be continued for 24 minutes at the spinning temperature of 382° C.

EXAMPLE 7

Isotropic pitch was obtained by the distillation of a catalytic cracking bottom to remove fractions having a boiling point of 530° C. (as converted to that in the atmospheric pressure). 17 g of the resulting pitch was charged in a reactor tube and subjected to the heat treatment at 483° C. for 8 minutes while introducing argon and tetrahydroquinoline as in Example 1.

The yield of the heat-treated pitch was 24 wt %, the mesophase content was about 80% and the quinoline insoluble content was 30%. The melt spinning could be continued for 20 minutes at the spinning temperature of 370° C.

COMPARATIVE EXAMPLE 4

Example 7 was repeated except that the heat treatment was carried out without tetrahydroquinoline. The yield of the heat-treated pitch was 23 wt %, the mesophase content was about 80% and the quinoline insoluble content was 38%. The melt spinning could be continued for 11 minutes at the spinning temperature of 385° C.

EXAMPLE 8

22 g of chloroform solubles of coal tar pitch was charged in the same reactor tube as used in Example 1 and subjected to the heat treatment at 453° C. for 80 minutes while introducing argon and tetrahydroquinoline as in Example 1.

The yield of the heat-treated pitch was 19 wt %, the mesophase content was about 90% and the quinoline insoluble content was 7%.

COMPARATIVE EXAMPLE 5

Example 8 was repeated except that the heat treatment was carried out without tetrahydroquinoline. The yield of the heat-treated pitch was 24 wt %, the mesophase content was about 100% and the quinoline insoluble content was 44%.

While the invention has been described in detail and with reference to specific embodiments thereof, it will be apparent to one skilled in the art that various changes and modifications can be made therein without departing from the spirit and scope thereof.

What is claimed is:

1. A process for producing a mesophase pitch, which comprises:

(a) pretreating a raw material pitch at an elevated temperature ranging from 400°–520° C. under a hydrogen pressure of 5 to 250 Kg/cm$^2$ to produce a modified isotropic pitch; and (b) heat-treating said modified pitch at a temperature of 350° to 550° C. while supplying to said modified pitch a hydrogen donor selected from the group consisting of partially hydrogenated condensed polycyclic aromatic compounds and nitrogen-containing heterocyclic compounds, thereby obtaining said mesophase pitch.

2. The process of claim 1, wherein the temperature of said heat treatment step is 380°–520° C.

3. The process of claim 1, wherein the temperature of said heat treatment step is 400°–500° C.

4. The process of claim 1, wherein said carbonaceous pitch is a pitch obtained from coal tar, residual oil, modified coal tar or modified residual oil.

5. The process of claim 4, wherein said residual oil is a catalytic cracking bottom.

6. The process of claim 1, wherein said raw material pitch is ethylene bottoms.

7. The process of claim 1, wherein said hydrogen donor is a compound selected from the group consisting of tetralin, 9,10-dihydroanthracene, 9,10-dihydrophenanthrene, hydropyrene and 1,2,3,4-tetrahydroquinoline.

8. The process of claim 1, wherein said hydrogen donor compound is supplied to said carbonaceous pitch in step (a) in an amount of 1 mmole to 10 mole/minute per 1 kg of pitch.

9. The process of claim 8, wherein said rate of hydrogen donor compound supply is 10 mmole to 1 mole/minute per 1 kg of pitch.

10. The process of claim 1, wherein, in said heat treatment step, an inert gas is blown through said carbonaceous pitch.

11. The process of claim 10, wherein the rate of inert gas supplied ranges from 200–5,000 liters per hour per one kg of pitch.

12. The process of claim 11, wherein said rate of inert gas supply ranges from 400 to 3,000 liters/hr per 1 kg of pitch.

13. The process of claim 1, wherein the heat-treatment step is conducted for a time of 10 seconds to 50 hours.

14. The process of claim 13, wherein the time of heat treatment ranges from one minute to 20 hours.

15. The process of claim 1, wherein said mesophase pitch product contains no more than 50 weight % quinoline insoluble material.

16. The process of claim 5, wherein carbon fibers are prepared from the mesophase pitch product of claim 5.

* * * * *